US009199834B2

(12) United States Patent
Drennow

(10) Patent No.: US 9,199,834 B2
(45) Date of Patent: Dec. 1, 2015

(54) DISPENSING DEVICE

(71) Applicant: Asept International AB, Lund (SE)

(72) Inventor: Sten Drennow, Lund (SE)

(73) Assignee: Aspet International AB, Lund (SE)

( * ) Notice: Subject to any disclaimer, the term of this patent is extended or adjusted under 35 U.S.C. 154(b) by 0 days.

(21) Appl. No.: 14/363,837

(22) PCT Filed: Dec. 7, 2012

(86) PCT No.: PCT/IB2012/057073

§ 371 (c)(1),
(2) Date: Jun. 9, 2014

(87) PCT Pub. No.: WO2013/084203

PCT Pub. Date: Jun. 13, 2013

(65) Prior Publication Data

US 2014/0367422 A1 Dec. 18, 2014

(30) Foreign Application Priority Data

Dec. 9, 2011 (SE) ..... 1100905

(51) Int. Cl.
*B65D 37/00* (2006.01)
*B67D 7/02* (2010.01)
(Continued)

(52) U.S. Cl.
CPC ..... *B67D 7/0216* (2013.01); *A47K 5/1215* (2013.01); *B05B 11/303* (2013.01); *B67D 1/108* (2013.01); *B67D 7/0205* (2013.01); *B67D 7/36* (2013.01)

(58) Field of Classification Search
CPC ..... B67D 1/108; A47K 5/1215
USPC ..... 222/207, 105, 209, 212–214
See application file for complete search history.

(56) References Cited

U.S. PATENT DOCUMENTS 1,326,880 A 12/1919 William
1,542,584 A 6/1925 William
(Continued)

FOREIGN PATENT DOCUMENTS

EP 0232571 A1 8/1987
WO 87/02422 A1 4/1987
(Continued)

OTHER PUBLICATIONS

International Search Report and Written Opinion received for PCT Patent Application No. PCT/IB2012/057073, mailed on Apr. 22, 2013, 7 pages.
(Continued)

*Primary Examiner* — Donnell Long
(74) *Attorney, Agent, or Firm* — Morrison & Foerster LLP

(57) ABSTRACT

The present invention relates to a dispensing device for dispensing a liquid foodstuff product from a container, wherein a hose member of elastic and resilient material is connectable with the container such that product can be made to flow from the container into the hose member. The hose member is compressible in order to dispense product therefrom and it is designed so as to regain, by its own resilience, an original shape after compression thereof. A check valve is arranged to close in order to prevent product, upon compressing the hose member, from flowing back from the hose member to the container, and a discharge valve is arranged to open so as to allow dispensing of product from the hose member and to close when so done.

13 Claims, 3 Drawing Sheets

(51) Int. Cl.

| | |
|---|---|
| ***A47K 5/12*** | (2006.01) |
| ***B67D 1/10*** | (2006.01) |
| ***B05B 11/00*** | (2006.01) |
| ***B67D 7/36*** | (2010.01) |

(56) References Cited

U.S. PATENT DOCUMENTS

| | | | | |
|---|---|---|---|---|
| 4,515,294 | A * | 5/1985 | Udall | 222/105 |
| 4,895,276 | A * | 1/1990 | Maldonado | 222/144.5 |
| 5,242,083 | A | 9/1993 | Christine et al. | |
| 5,248,066 | A | 9/1993 | Olson et al. | |
| 7,802,763 | B2 * | 9/2010 | Faller et al. | 248/95 |
| 2006/0049208 | A1 * | 3/2006 | Daansen | 222/212 |
| 2007/0068966 | A1 | 3/2007 | Orzech et al. | |
| 2009/0308887 | A1 * | 12/2009 | Woo et al. | 222/52 |
| 2010/0301070 | A1 * | 12/2010 | Allef et al. | 222/207 |

FOREIGN PATENT DOCUMENTS

| | | | |
|---|---|---|---|
| WO | 93/09408 | A1 | 5/1993 |
| WO | 03/010085 | A1 | 2/2003 |

OTHER PUBLICATIONS

International Preliminary Report on Patentability received for PCT Patent Application No. PCT/IB2012/057073, issued on Feb. 26, 2014, 6 pages.

* cited by examiner

DISPENSING DEVICE

CROSS REFERENCE TO RELATED APPLICATIONS

This application is a U.S. National Phase patent application of PCT/IB2012/057073, filed on Dec. 7, 2012, which claims priority to Swedish Patent Application No. 1100905-7, filed on Dec. 9, 2011, each of which is hereby incorporated by reference in the present disclosure in its entirety.

FIELD OF THE INVENTION

The present invention relates to a dispensing device for dispensing a liquid foodstuff product from a container, wherein a hose member of an elastic and resilient material is connectable with the container so that product can be made to flow from the container into the hose member, which is compressible in order to dispense product therefrom. The hose member is designed so as to regain, by its own resilience, an original shape after compression thereof. A check valve is arranged to close so as to prevent product, upon compressing the tube member, from flowing back into the container, and a discharge valve is arranged to open so as to allow dispensing of product from the hose member and close it when so done. The hose member is disposed in a tube member or the like, and a pressure means is provided for compressing side portions of the hose member in order to dispense product therefrom.

Known examples of dispensing devices are disclosed in WO 03/010085 A1 and US 2007/068966 A1. WO 03/010085 A1 discloses a handheld dispensing device with a housing that may be gripped in one hand for manually actuating a pump for dispensing substance out of one or more dispensing nozzles. US 2007/068966 A1 discloses a dispensing device using a peristaltic pump including a motor for dispensing food products.

SUMMARY OF THE INVENTION

A dispensing device of the type described above is known from the document U.S. Pat. No. 5,730,327. This known dispensing device has a hose member which you grip and compress by your hand to dispense the product contained therein. Since the hose member is more or less compressible and at different locations thereof, the quantity of product dispensed in each case may vary widely. This means that this known dispensing device cannot be used if it is desired to dispense precise quantities of product each time and at several consecutive instances. Additionally, it is a problem that the hose member must be thick-walled in order to withstand many and rapid compressions, which with respect to the manufacture and power requirement thereof may be disadvantageous.

The object of the present invention is to provide a dispensing device which by simple means eliminates these problems, and this is solved essentially in that the invention exhibits the characterizing features set forth in the appended claims.

In that the invention exhibits the said characteristics it is achieved that a predefined, exact quantity of product can be dispensed each time and also at several successive instances. Furthermore, the hose member can be designed with thin walls, thereby making it easy to compress for dispensing the product. In addition, the hose member gets the support necessary during dispensing and is thus in a completely protected position.

DETAILED DESCRIPTION OF THE INVENTION

Figure 1:
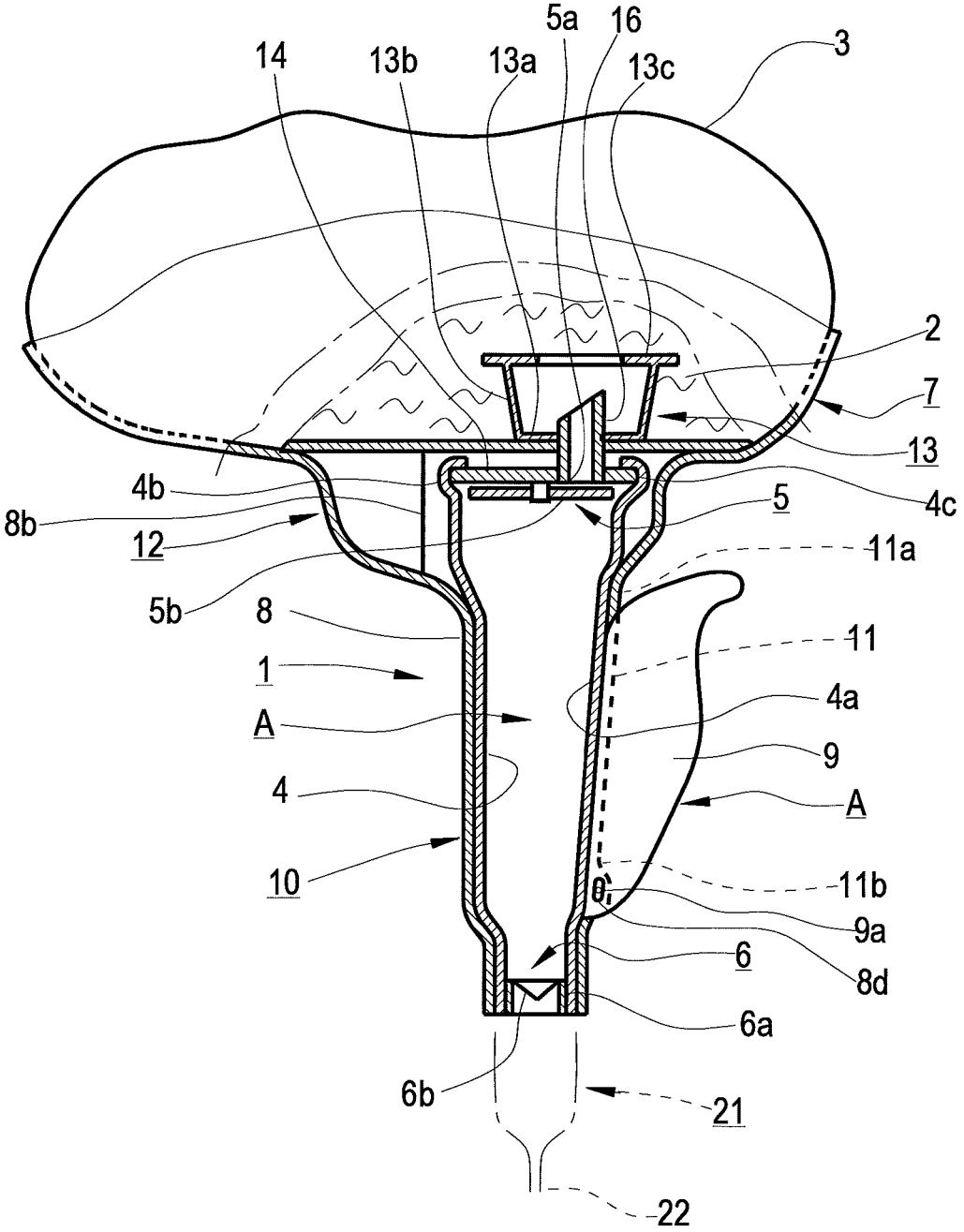
FIG. 1 shows a section of a dispensing device according to the invention with a container positioned thereon.
Figure 2:
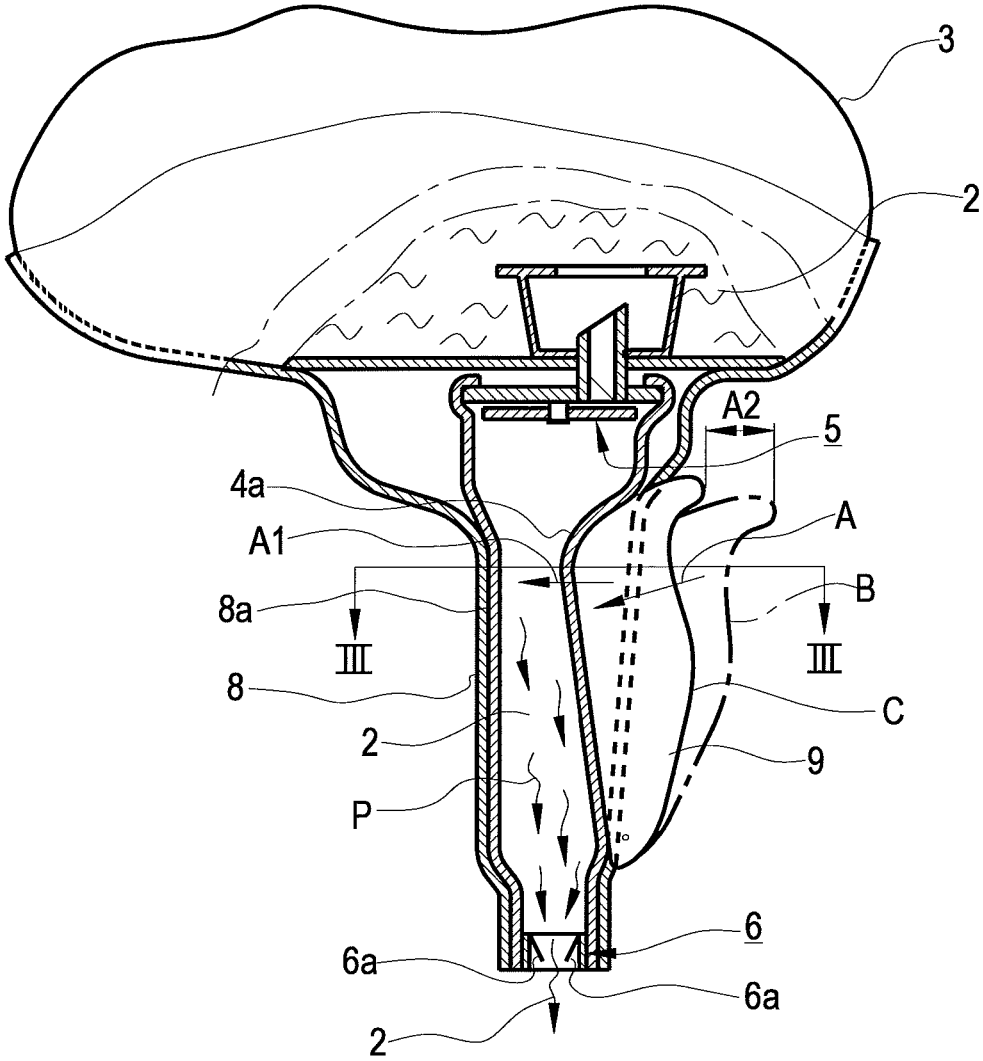
FIG. 2 shows the dispensing device according to FIG. 1 where product is dispensed therefrom.
Figure 3:
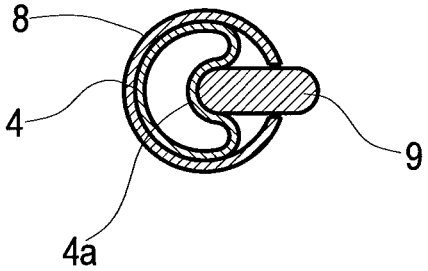
FIG. 3 shows a section 3-3 of the dispensing device according to FIG. 2.
Figure 4:
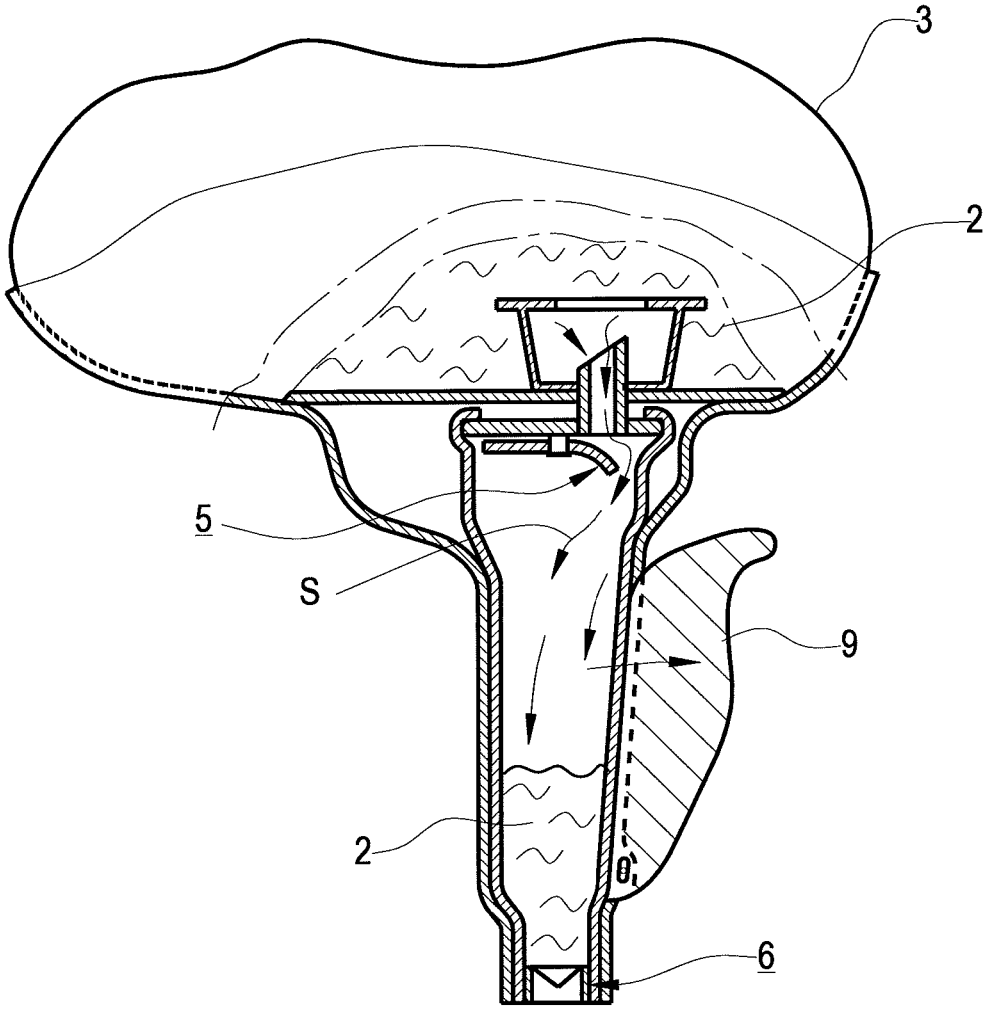
FIG. 4 shows the dispensing device according to FIG. 1 where product is sucked out from the container.

The dispensing device 1 shown in FIGS. 1-4 is intended for dispensing a liquid foodstuff product 2, e.g. ketchup, mustard, dressing or the like, from a container 3 of flexible material. A hose member 4 of elastic and resilient material is connectable with the container 3 so that product 2 can flow from the container 3 into the hose member 4. The hose member 4 is compressible so as to dispense the product 2 therefrom, and it can regain its original shape when the compressing stops. A check valve 5 is arranged to close so as to prevent the product 2, upon compressing the hose member 4, from flowing back from the hose member 4 into the container 3, and a discharge valve 6 is arranged to open so as to allow discharge of the product 2 out from the hose member 4 and to close it when so done.

The container 3 is positionable in a cup-shaped member 7 having a tube member 8, which is designed so as to allow insertion of the hose member 4 therein simultaneously with the container 3 being placed in the cup-shaped member 7. The tube member 8 has a pressure means 9 which can be imparted with a dispensing movement A into the tube member 8 in order to press in the side portions 4*a* of the hose member 4 into it and into the tube member 8 in a direction A1 towards opposite portions 8*a* of the tube member 8, the latter portions 8*a* constituting support for the hose member 4. By this compressing of the side portion 4*a*, the volume in the hose member 4 is reduced causing product 2 to be dispensed therefrom. In that the hose member 4 with essential portions of its circumference and essential portions of its length abuts against the tube member 8 it thus forms a support sleeve 10 for the hose member 4 at the dispensing of product 2.

The pressure means 9 is so arranged that it can be imparted with dispensing movements A with predetermined size A2 (see FIG. 2) to achieve a predetermined volume reduction of the inner parts of the hose member 4 and thus dispense a predetermined quantity of product 2 from the hose member 4 at each dispensing instance.

To be able to compress the hose member 4 by the lowest possible compressive force on the pressure means 9, the said member can be pivotally mounted on the tube member 8 as a single-arm lever.

The pressure means 9 is also preferably arranged so that it can compress such side portions 4*a* of the hose member 4 that are closest to the check valve 5 farther into the tube member 8 than such portions of the hose member 4 that are closest to the discharge valve 6. Hereby it is facilitated that product 2 flows in direction P towards the discharge valve 6 and via this out of the hose member 4.

The tube member 8 has an oblong slot 11 extending in a longitudinal direction upwards along the same, and the pressure means 9 is oblong, extending along the slot 11 and being insertable therein in order to compress the side portions 4*a* of the hose member 4 in the tube member 8. The pressure means 9 is pivotably mounted at the tube member 8 below the slot 11, and thus it may be pivoted so that the side portions 4*a* within upper portions 11*a* of the slot are pressed farther into the tube member 8 than the hose member 4 within lower portions of the slot 11*b*.

The hose member 4 is so flexibly formed that its compressed side portions 4*a* can spring back to an original shape, and thereby they can return the pressure means 9 from a compressed position C to its initial position B.

The tube member 8 may be designed as a handle which can be gripped by a hand, and the pressure means 9 may be arranged to be operated by the same hand. Furthermore, the pressure means 9 can preferably be snapped onto the tube member 8 so as to be pivotable in relation thereto. The hose member 4 and the tube member 8 may be conically tapered in the direction from the check valve 5 and the cup-shaped member 7, and the tube member 8 may be designed as a unit of the same material.

The cup-shaped member 7 may have a downwards directed portion 12 which downwardly passes into the tube member 8, the said downwards directed portion 12 being designed to allow that such portions 4*b* of the hose member 4, which exhibit the check valve 5, can be passed down into it.

The check valve 5 is disposed in an inlet portion 4*b* of the hose member 4 and it has an attachment part 14 in the form of a plate of the like, which engages with an annular groove 4*c* in the inlet portion 4*b* so that the attachment part 14 is fixedly attached thereto. The attachment part 14 has a tubular coupling part 16, extending through the attachment part 14 in an upwards direction therefrom, which has an inclined end edge and around which an inner side of the attachment part 14 forms a valve seat 5*a* for the check valve 5. The said valve has a valve body 5*b* of flexible material, which is disposed on the attachment part 14 so that it can interact with the valve seat 5*a* to close the check valve 5.

In the inlet portion 4*b* of the hose member 4 there may be support parts 8*b* to prevent the inlet portion 4*b* from expanding in radial directions when the pressure in the hose member is increased. This prevents leakage from arising between the attachment part 14 and the inlet portion 4*b*.

The discharge valve 6 may have an annular outer portion 6*a* and a number, for example three, of valve flaps 6*b* directed inwards towards each other and being arranged to abut against each other with inner edges in order to keep the discharge valve 6 closed. The outer portion 6*a* and the valve flaps 6*b* are preferably formed in one piece of a flexible material. The valve flaps 6*b* are designed so that they can be folded away almost completely in order to completely open the discharge valve 6 so that also large particles in the product 2 can pass out through the same. Furthermore, the valve flaps 6*b* are arranged to spring back to their original positions when the pressure in the hose member 4 stops so as to close the discharge valve 6.

The discharge valve 6 is designed such that the tube member 8, directly or via the hose member 4, grips its annular outer portion 6*a* so that the tube member 8 prevents the outer portion 6*a* from expanding in radial directions. Hereby it is ensured that the valve flaps 6*b* are sure to spring back to their valve-closing positions and are retained therein, whereby subsequent dripping from the hose member 4 is prevented.

A special embodiment of the pressure means 9 can be configured to dispense a specific quantity of product 2 from the hose member 4, and such a pressure means 9 may be interchangeable with another pressure means 9 of another embodiment to dispense a different amount of product 2. In combination therewith, or as alternative thereto, the position of a pressure means 9 on the tube member 8 can be changed so as to achieve the same purpose.

In the embodiment of the container 3 shown in FIGS. 1-4, the container has an inner coupling part 13 which may have an annular outer portion 13*a* disposed on the inner side of an unbroken wall portion of the container 3. The said outer portion 13*a* may have a number of inwards directed legs 13*b* and an annular inner portion 13*c* disposed thereon.

In order to dispense product 2 from a container 3, the container is first placed on a support, and the hose member 4 is connected thereto by pressing the coupling part 16 through the wall portion of the container 3 and pressing the coupling part 16 fixedly onto the annular outer portion 13*a* of the inner coupling part 13. Hereby the hose member 4 is attached to the container 3, and communication is established between the container 3 and the hose member 4 so that product 2 can flow into it from the container 3.

The container 3 with the hose member 4 attached thereto is then placed in the cup-shaped member, and the hose member 4 is passed down into the tube member 8. Hereafter, the tubular member 8, which is thus formed as a handle, is gripped by the hand, and the pressure means 9 can be compressed by the same hand. This entails that the side portions 4*a* of the hose member 4 are compressed, and when you let go of the pressure means 9, the said side portions 4*a* return to their original shape whereby a subpressure arises in the hose member 4, the valve 5 thereby opening and product 2 being caused to flow from the container 3 into the hose member 4 (see FIG. 4, arrows S). When this has happened and the pressure means 9 is compressed again, the pressure in the hose member 4 will close the check valve 5 and open the discharge valve 6, and a specific quantity of product 2 will be dispensed from the hose member 4 through the discharge valve 6 (see FIG. 2, arrows P). When this dispensing has been completed and you let go of the pressure means 9, the side portion 4*a* returns to its original shape and returns the pressure means 9 to its initial position B. Furthermore, the volume in the hose member 4 will thereby increase, and the check valve 5 is thereby opened again and a new portion of the product 2 is sucked into the tube member 4.

Figure 5:
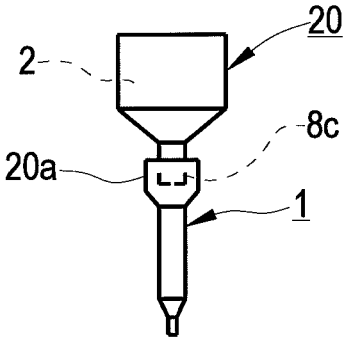
FIG. 5 shows schematically parts of the dispensing device according to the invention with an alternatively shaped container.

In the embodiment according to FIG. 5, the dispensing device 1 is used for dispensing product from a type of container 20 which differs from the container 3. The dispensing device 1 may be directly connectable with the said container 20, or be connectable therewith via a hose (not shown). In order to be able to connect the dispensing device 1 directly with the container 20, it has a coupling part 20*a* which may have external threads. The tube member 8 may in this case have a coupling part 8*c* with inner threads so that the coupling parts 20*a*, 8*c* can be coupled with each other by being screwed onto each other. The inlet portion 4*b* of the hose member 4 may in this case abut tightly against the inner side of the tube member 8 so that product 2 cannot penetrate between the hose member 4 and the tube member 8. The coupling parts 20*a*, 8*c* are open, and product 2 can therefore flow from the container 20 into the hose member 4 when check valve 5 is open. Incidentally, the dispensing device 1 can have the same or a similar embodiment as in FIGS. 1-4, and the dispensing of product 2 takes place in the manner previously described.

The invention is not limited to the embodiment described above but may vary within the scope of the appended claims. Thus, the different portions of the dispensing device 1 may be differently shaped, and this also applies to the containers 3 and 20. For example, the tube member 8 may have a different wall structure than that shown and there may be more than one pressure means 9. As examples of details not more closely described, it could be mentioned that the pressure means 9 may comprise a shaft-like portion 9*a* which can be hooked into an oblong hole 8*d* in the tube member 8 such that the portion 9*a* can be turned in the oblong hole 8*d*. Additionally, in its function as a support sleeve 10, the tube member 8 can constitute a support for the hose member 4 and allow it to accurately resume its original shape. The container 3 can/must be completely closed before it is connected with the hose member 4. Furthermore, there may be a second hose member 21 with a second discharge valve 22, and this second hose member 21 may be connectable with the first mentioned hose member 4 and/or with the tube member 8 so that the second discharge valve 22 will be located downstream of the first mentioned discharge valve. This ensures that one of the discharge valves can keep the device closed if the other one for some reason cannot be closed, for example if a large particle in the product 2 gets stuck therein.

The invention claimed is:

1. A dispensing device for dispensing a liquid foodstuff product from a container of flexible material by means of hand-operation, the container and a hose member of elastic and resilient material being connectable with each other such that product can flow from the container into the hose member;

the hose member being compressible in order to dispense product therefrom, the hose member being designed so as to regain, by its own resilience, an original shape after compression thereof, a check valve being arranged to close so as to prevent product, upon compressing the hose member, from flowing back into the container;

a discharge valve being arranged to open so as to allow dispensing of product from the hose member and to close when so done, the hose member being disposed in a tube member or the like, and a pressure part being arranged to compress side portions of the hose member in order to dispense product therefrom, the tube member having an oblong slot extending in a longitudinal direction along the tube member;

the pressure part being oblong, extends along the slot, and is insertable therein in order to compress side portions of the hose member in the slot, and the pressure part being pivotally mounted on tube member as a one-arm lever, wherein the container and the hose member can be coupled with each other by pressing a tubular coupling part, which is connected with the hose member, through a wall portion of the container and pressing the coupling member fixedly onto an inner coupling part disposed in the container, whereby communication is established between the container and the hose member so that product can flow from the container into the tube member, the tube member is disposed on a cup-like member being designed such that the container can be laid down therein, and the tube member is disposed on the cup-shaped member in such a manner that when the container is laid down therein, the hose member can be passed down into the tube member, and the cup-shaped member and the tube member are formed as one unit of the same material.

2. The dispensing device according to claim 1, wherein the discharge valve has an annular outer portion and valve flaps arranged thereon and being directed inwards against each other, the said flaps being arranged so as to abut against each other in order to keep the discharge valve closed, the valve flaps are arranged so as to be made to fold away to substantially open the discharge valve so that product can flow out from the hose member, and the tube member, directly or via the hose member, grips the outer portion and supports it in order to prevent the outer portion from expanding in radial directions, whereby it is ensured that the valve flaps, after opening of the discharge valve, return to abutment against each other and remain in these positions.

3. The dispensing device according to claim 1, wherein the tube member is designed so as to form a support sleeve to support the hose member when the side portions thereof are compressed and to allow the hose member to accurately regain its original shape.

4. The dispensing device according to claim 1, wherein the pressure part is arranged so as to compress side portions of the hose member in a direction towards opposite portions of the tube member so that the said opposite portions constitute support members for the hose member when it is compressed.

5. The dispensing device according to claim 1, wherein the hose member with essential portions of its circumference and its length abuts against the tube member so that it forms a support sleeve for the hose member.

6. The dispensing device according to claim 1, wherein the pressure part is arranged so as to compress such side portions of the hose member that are disposed closest to the check valve farther in than such other portions of the tube member that are disposed in the vicinity of the discharge valve.

7. The dispensing device according to claim 1, wherein the hose member is designed such that compressed side portions thereof spring back to an original shape when pressure thereon ceases, whereby the said side portions return the pressure part from a compressed position to an initial position.

8. The dispensing device according to claim 1, wherein the pressure part can be snapped onto the tube member so that it can be pivoted in relation thereto.

9. The dispensing device according to claim 1, wherein both the hose member and tube member are conically tapered.

10. The dispensing device according to claim 1, wherein the hose member has an inlet portion which is designed for accommodating the check valve, and the tube member has support portions in order to prevent the inlet portion from extending in radial directions.

11. The dispensing device according to claim 1, wherein different pressure part are attachable to the tube member and/or that the pressure part is positionable at various places on the tube member in order to dispense different amounts of product depending on which pressure part are used and/or where they are disposed on the tube member.

12. The dispensing device according to claim 1, wherein the container is completely closed before it is connected with the hose member.

13. The dispensing device according to claim 1, wherein the hose member and/or the tube member is/are connectable with a second hose member having a second discharge valve, which is disposed, in the direction of flow, after the first mentioned discharge valve.

* * * * *